United States Patent [19]

Noeske

[11] 4,354,072

[45] Oct. 12, 1982

[54] PYROLYTIC CARTRIDGE INTERRUPTION ASSISTANCE ACTUATOR FOR PUFFER BREAKER

[75] Inventor: Heinz O. Noeske, Cherry Hill, N.J.

[73] Assignee: General Electric Company, Schenectady, N.Y.

[21] Appl. No.: 87,403

[22] Filed: Oct. 22, 1979

[51] Int. Cl.[3] ..... H01H 33/88

[52] U.S. Cl. ..... 200/148 A; 200/82 A; 200/148 R

[58] Field of Search ..... 200/148 A, 150 R, 148 R, 200/82 A, 61.08

[56] References Cited

U.S. PATENT DOCUMENTS

| | | | |
|---|---|---|---|
| 723,183 | 3/1903 | Read | 200/148 R |
| 2,104,914 | 1/1938 | Temple, Jr. | 200/150 R |
| 2,552,358 | 5/1951 | Whitney et al. | 200/148 R |
| 2,920,170 | 1/1960 | Caswell | 200/148 R |
| 3,190,990 | 6/1965 | Perry | 200/61.08 |
| 3,264,438 | 8/1966 | Gay | 200/61.08 |
| 3,281,561 | 10/1966 | Marx et al. | 200/150 R |
| 3,384,724 | 5/1968 | Marx et al. | 200/150 R |
| 3,739,125 | 6/1973 | Noeske | 200/148 A |
| 4,041,263 | 8/1977 | Noeske | 200/148 A |

OTHER PUBLICATIONS

Keinert et al., New Switchgear for Present and Future Requirements of Medium Voltage Distribution Systems, CIRED, 1976.

*Primary Examiner*—Robert S. Macon

*Attorney, Agent, or Firm*—Lawrence D. Cutter; James C. Davis, Jr.; Marvin Snyder

[57] ABSTRACT

A puffer breaker employs a low energy actuating mechanism during normal opening and closing operation and a pyrolytic cartridge actuating mechanism for high speed operation under fault conditions. A current detector is provided in circuit with the puffer breaker to control operation of the actuating mechanisms, so that whenever a fault condition is detected, the pyrolytic cartridge actuating mechanism rapidly opens the circuit breaker.

11 Claims, 6 Drawing Figures

PYROLYTIC CARTRIDGE INTERRUPTION ASSISTANCE ACTUATOR FOR PUFFER BREAKER

BACKGROUND OF THE INVENTION

This invention relates to a circuit breaker of the puffer type, and more particularly to such a puffer breaker having a pyrolytic cartridge actuating mechanism for opening the contacts of the circuit breaker under fault conditions.

Puffer breakers in which an insulating gas is used as the interruption medium produce a high gas pressure, which is required for interruption of an arc produced by opening of the contacts of the breaker, by adiabatic compression of the insulating gas in the puffer during opening. One advantage of puffer breakers is that no heaters are required to prevent liquefaction of the insulating gas during periods of low ambient temperature, as for example, in breakers using sulfur hexafluoride, $SF_6$, so long as the pressure within the circuit breaker is kept below approximately 45 psig. A high pressure within the puffer at current zero, the time at which the arc can be most easily interrupted, is desirable, because high gas pressure increases arc cooling performance, thereby increasing the magnitude of current the breaker is capable of interrupting. Another measure of performance improved by use of higher pressure is the magnitude of the initial rate of rise of recovery voltage after current zero which can be withstood by the breaker. However, the higher the pressure required to ensure breaker performance, the larger the mechanical actuation means required to produce such high pressure in the puffer, since the force the actuating piston has to overcome is determined by the pressure difference between the ambient pressure and the pressure inside the puffer. A larger puffer volume and a faster compression of the gas in the puffer during interruption can be used to achieve higher pressure at interruption, but the required high power of the mechanical actuator for such a construction makes this solution costly and inefficient.

Using such large actuating equipment for each breaker operation is inefficient, since the vast majority of circuit breaker openings occur at low current levels, which do not require high pressurization of insulating gas that is required during fault interruption operation. In a particular examination of circuit interruptions, it was found that 3,000 switchings of rated continuous current occured before occurrence of ten interruptions at rated maximum interruption current, i.e., fault interruptions. Therefore, during only 0.3% of puffer breaker openings is the high power required to operate the mechanical actuator under fault conditions needed. Because the same mechanical actuator is used to operate the breaker for normal current operations as for fault current operations, the mechanical actuator must be designed to the specifications of fault current operation. Using the fault current for all breaker operations wastes operating energy, and also produces excess wear of the mechanical actuator.

Prior art attempts to provide the necessary compression of insulating gas include cartridge type circuit breakers as disclosed in U.S. Pat. No. 3,384,724, issued May 21, 1968 to Marx et al. Oil is propelled rapidly by a piston actuated by an explosive cartridge to extinguish an arc drawn between contacts of the circuit breaker. In such structures, the pyrolytic cartridge is detonated at any opening of the contacts to force a flow of coolant over the arc between the contacts. Since this system requires a cartridge opening device for each opening, frequent maintenance will be required for such a breaker.

The prior art includes a circuit breaker using a pyrolytic cartridge for actuation as shown in U.S. Pat. No. 3,281,561, issued Oct. 25, 1966 to Marx et al. This patent illustrates a device for inserting an insulating wall between the opened contacts using a pyrolytic cartridge to move the insulating wall. The insulating fluid used is oil. Another prior art device is illustrated in U.S. Pat. No. 3,264,438, issued Aug. 2, 1966 to Gay in which separation of a connecting bar 21 from conductors 17 and 19 is accomplished using an explosive or gas-forming charge 38 to drive a piston connected to bar 21. Each of these prior art devices employs the same actuating mechanism for every breaker opening.

It is therefore an object of the instant invention to provide high speed, high pressure puffer action to interrupt a circuit at its highest rated current, and to provide in the same device an alternative actuating mechanism for circuit opening at normal continuous current levels.

Another object of the instant invention is to provide a mechanical actuator to operate a circuit breaker under normal continuous current operation, and to provide a pyrolytic cartridge actuator for operating said circuit breaker at maximum interruption current operation.

BRIEF DESCRIPTION OF THE DRAWINGS

The features of the invention believed to be novel and unobvious are set forth with particularity in the appended claims. The invention itself, however, both as to organization and method of operation, together with objects and advantages thereof, may best be understood by reference to the following description taken in conjunction with the accompanying drawings in which:

Manner and Process of Making and Using the Invention

Figure 1:
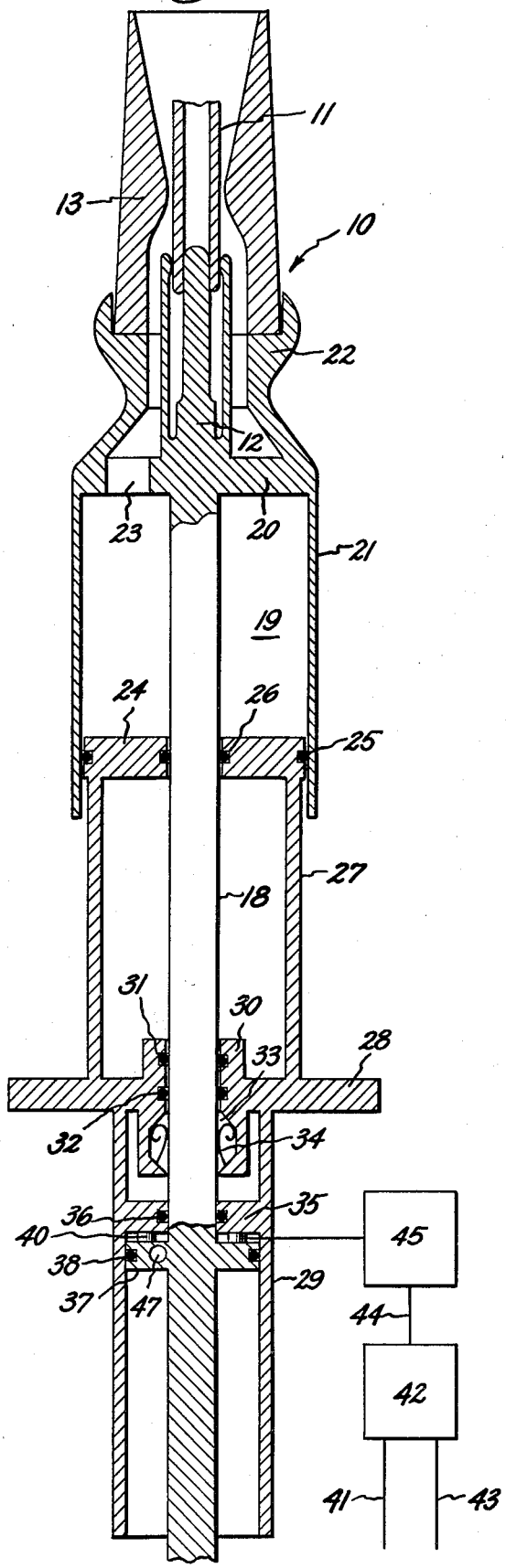
FIG. 1 is a partial schematic cross-sectional view of a puffer breaker incorporating the instant invention.
Figure 2:
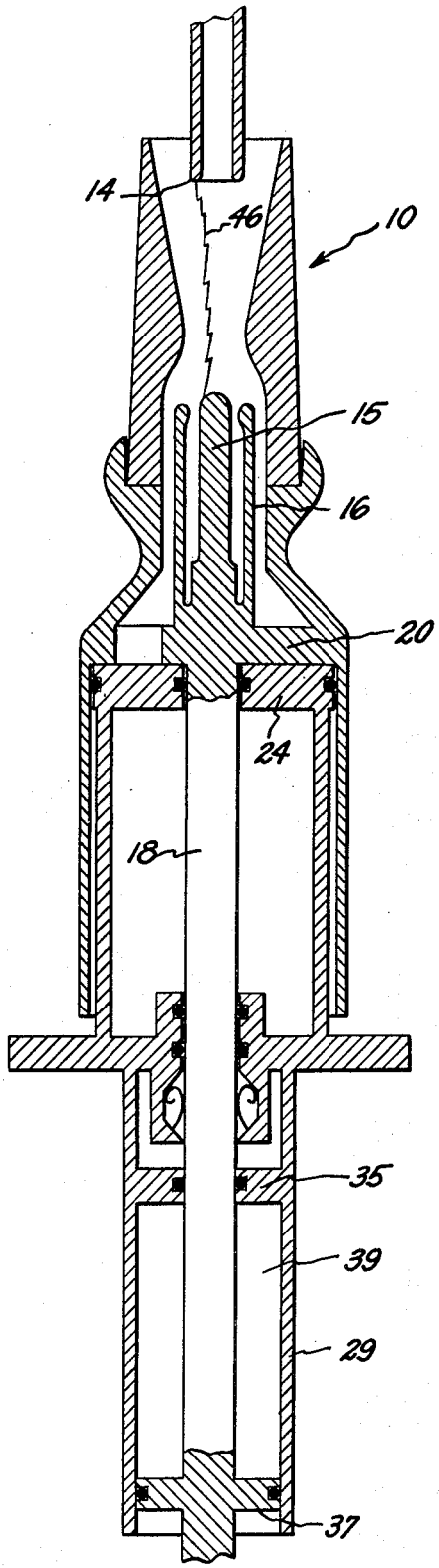
FIG. 2 is a partial schematic cross-sectional view showing the circuit breaker of FIG. 1 with the contacts in the fully-opened position.

FIGS. 1 and 2 illustrate a puffer breaker incorporating the instant invention, and show the circuit breaker with the current-carrying contacts in the closed and open positions, respectively. Puffer breaker 10 includes fixed contact means 11 and movable contact means 12 having nozzle means 13 connected thereto. Fixed contact means 11 comprises a hollow cylindrical member having a tip 14 made of materials, such as copper-tungsten, which are able to withstand the heat generated by an arc at contact opening. Contact means 12 comprises centrally disposed arcing electrode 15 and concentrically surrounding electrode 15 a plurality of contact fingers 16 which carry the current when the breaker is in the "closed" position.

Contact means 12 is movable axially with respect to contact means 11 by means of actuating rod 18, which extends axially through puffer chamber 19 to mechanical actuating means (not shown). Contact means 12 is mounted on end wall 20 disposed between contact means 12 and actuating rod 18, and hollow cylindrical wall 21 is attached to the outer periphery of end wall 20. Attached to the outer periphery of end wall 20 on the major surface opposite cylindrical wall 21 is nozzle support means 22 on which nozzle 13 is mounted. End wall 20 has a plurality of circumferentially-spaced openings 23 therein for supplying insulating gas to said nozzle, when said contacts are moved from the closed position to the open position.

Chamber 19 is closed by annular piston 24 and O-rings 25 and 26 or other suitable sealing means, to provide a gas-tight seal between piston 24 and cylindrical wall 21 and actuating rod 18, respectively. Piston 24 is supported by cylindrical wall 27 rigidly affixed to plate 28, which is supported on cylindrical wall 29 from suitable support means (not shown). Attached to plate 28 is a sleeve 30 having O-rings 31, 32 disposed therein, such that a seal is formed between actuating rod 18 and the sleeve 30. In the annular trapezoidal-shaped space 33 contact springs 34 are located to make electrical connection between rod 18 and sleeve 30. Attached to cylindrical wall 29 is an annular plate 35 and O-ring 36 forming a seal between plate 35 and rod 18. Annular shoulder 37 is rigidly affixed to actuating rod 18 and disposed within wall 29. O-ring 38 forms a seal between plate 37 and wall 29. A space 39 is provided between the walls 35 and 37 and is bounded by actuating rod 18 and wall 29, to define a space in which a plurality of pyrolytic charges 40 is disposed.

Line 41 connects a current sensor (i.e., a current transformer) to a current level detector 42 which continually monitors the current flowing through the circuit breaker. If an opening command is received from main actuating means while the current is within the normal operating range, detector 42 will transmit a signal via line 43 to cause a mechanical operating mechanism to open the contacts in normal fashion. If a fault current condition is detected by detector 42 which requires a larger actuator force for breaker opening, a detonating signal will be transmitted via line 44 to detonator 45 to detonate one or more of pyrolytic cartridges 40, which provide a high power, rapid contact opening mechanism. Current level detector 42 could be of the type currently in regular use as static current level detectors in transmission line relay systems such as, for example, in the SO-Y-61 Series of the General Electric Company, which sense a current rise to a peak above a certain predetermined current level. Alternatively, a detector which measures rate of change of current, dI/dt, could be used to initiate the detonation signal whenever the rate of change rises to a level above a predetermined rate.

In FIG. 2 is shown circuit breaker 10 of FIG. 1 following opening of the contacts. Chamber 39 is expanded by movement of wall 37 away from fixed wall 35 and simultaneously space 19 (FIG. 1) is closed by the movement of wall 20 downwardly toward piston 24, thereby compressing the insulating gas stored within chamber 19 during normal closed operation of the circuit breaker and ejecting it through openings 23 into nozzle 13 to cool the arc 46 drawn between the relatively movable contacts. A valve 47 may be inserted in plate 37 to allow escape of gases generated by detonation of a cartridge to facilitate breaker reclosing.

By operating the mechanism as described above, a simple, low mass mechanical actuator can be utilized to open the contacts under no load or under the normal continuous current load, and adequate power for rapid breaker opening under short line fault or terminal fault conditions can be provided by the pyrolytic cartridges, which provide adequate power to the mechanism to rapidly open the contacts and compress the insulating gas to a pressure high enough to extinguish a high current arc. The plurality of charges 40 would normally contain enough charges to perform the rapid opening operation several times, e.g., 10 to 15 times, so that only during regular servicing of the breaker would replacement of charges 40 be required.

Figure 3:
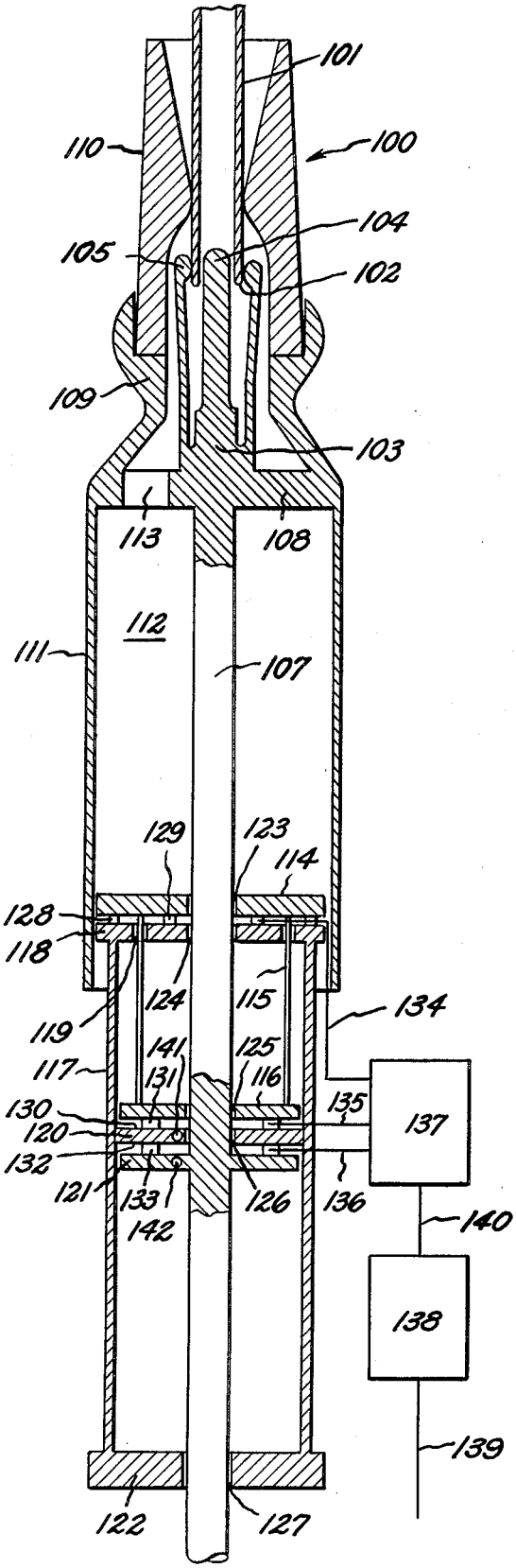
FIG. 3 is a partial schematic cross-sectional view of an alternative embodiment of the instant invention showing the contacts in the closed condition.
Figure 4:
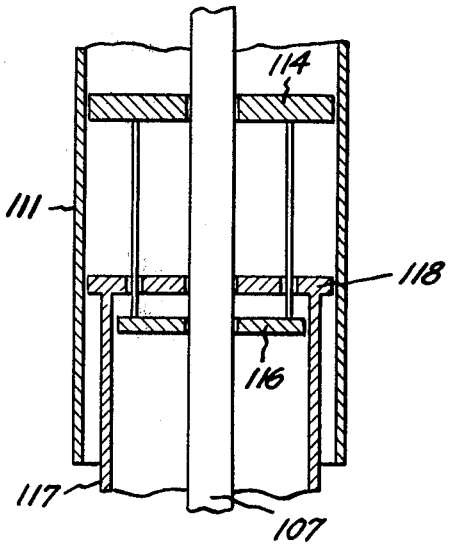
FIG. 4 is a schematic partial cross-sectional view illustrating a specific feature of the puffer breaker shown in FIG. 3.

An alternative embodiment of my invention is illustrated in FIGS. 3 and 4. Circuit breaker 100 comprises fixed contact 101 having contact tip 102 and movable contact 103 comprising centrally located arcing contact 104 and a plurality of contact fingers 105 surrounding arcing contact 104 and disposed concentrically therewith. Contact 103 is moved relative to contact 101 by actuating rod 107. Attached to rod 107 is end wall 108 having annular collar 109 to which nozzle 110 is attached. Also attached to end wall 108 is cylindrical casing 111 defining therewithin a cylindrical chamber 112, within which a volume of insulating gas is stored during closed circuit operation of circuit breaker 100. End wall 108 has a plurality of circumferentially spaced openings 113 therein in flow communication with the interior of collar 109 and nozzle 110, through which insulating gas stored in chamber 112 is blown over an arc drawn between contacts 101 and 103 during the contact opening to cool and extinguish the arc. At the axial end of chamber 112 opposite end wall 108 is an annular piston 114 which closes chamber 112 between actuating rod 108 and cylindrical casing 111. Suitable seals (not shown) of conventional design provide tight fit between piston 114 and rod 107 and between piston 114 and casing 111 to prevent escape of insulating gas from chamber 112 except through openings 113. A plurality of drive rods 115 are connected to piston 114 at one end thereof and to a piston 116 at the other end thereof. Piston 116 is disposed within fixed casing 117 to which fixed annular wall 118 is attached and suitable seals (not shown) provide tight fit between piston 116 and casing 117 and rod 107. Drive rods 115 pass through openings 119 in wall 118. Annular shoulder 120 is attached to casing 117 at a location such that piston 116 is adjacent shoulder 120 when the contacts are closed as shown in FIG. 3. A circular disk 121 is rigidly attached to rod 107, such that it is axially adjacent the major surface of shoulder 120 opposite piston 116, when the contacts are closed. Housing 117 has end wall 122 attached thereto to define a closed annular chamber 123 within housing 117. Actuating rod 107 passes through openings 123, 124, 125, 126, 127 in piston 114, wall 118, piston 116, shoulder 120 and end wall 122, respectively.

A plurality of pyrolytic cartridges is disposed between piston 114 and wall 118 in concentric rings 128, 129. A second plurality of pyrolytic cartridges is attached to surface shoulder 120 in a ring 131 concentric with rod 107. A third plurality of pyrolytic cartridges is attached to surface 132 of shoulder 120 in a ring 133 concentric with rod 107. Cartridges 128, 129 are shown as concentric rings of cartridges and cartridges 131, 133 are shown as single rings of cartridges, respectively, but other arrangements could be employed. Cartridges 128 and 129 are connected via line 134, and cartridges 131, 133 are connected via lines 135, 136, respectively, to cartridge detonator 137, which initiates detonation of the respective cartridges according to a predetermined sequence, described below. A current detector 138, similar to detector 42, described above, is connected via line 139 to a current sensor and provides a signal via line 140 to detonator 137 indicative of a current parameter (e.g., current level or dI/dt) in circuit breaker 100.

If opening of the contacts 101, 103 is required at normal current detector 138 transmits no signal to detonator 137, and the conventional actuation means (not shown) will operate to open the contacts by moving actuating rod 107. Volume of chamber 112 will be reduced by movement of wall 108 toward piston 114, and a flow of insulating gas from chamber 112 will be blown through openings 113 to cool and extinguish any arc which might occur under normal current operation.

If opening of the contacts is required because of a fault or other overload condition detected by detector 138, detector 138 provides detonator 137 with a signal to detonate the pyrolytic cartridges according to a predetermined sequence. Pyrolytic cartridges 128, 129 and 131 are detonated to drive pistons 114 and 116 upward to precompress the insulating gas disposed within chamber 112. This moves piston 114 and piston 116 to the position shown in FIG. 4. Check valves 141, 142 in shoulder 120 and disk 121, respectively, provide flow into the increasing volume between 116 and 120. When piston 114 has travelled far enough in the upward direction it is latched to rod 107 to plate 18 by a magnetic or other latching mechanism, so that the gas within chamber 112 remains under compression. Immediately thereafter, pyrolytic cartridges 133 are detonated to assist in driving rod 107 downward. The gas in 112 is further compressed by downward movement of wall 108, and the high pressure insulating gas is blown through openings 113 over an arc drawn between contacts 101 and 103 at opening. When 108 reaches the now stationary 114, after the arc is extinguished, the latching between 114 and 107 is released and both 114 and 108 move together until 114 reduces its position of FIG. 3. Thereby, the movable contact 103 is brought to the full opening position for maximum dielectric strengths between breaker contacts 103 and 101. When reclosing is required the latching mechanism must release to allow all parts to return to the closed position shown in FIG. 3.

Figure 5:
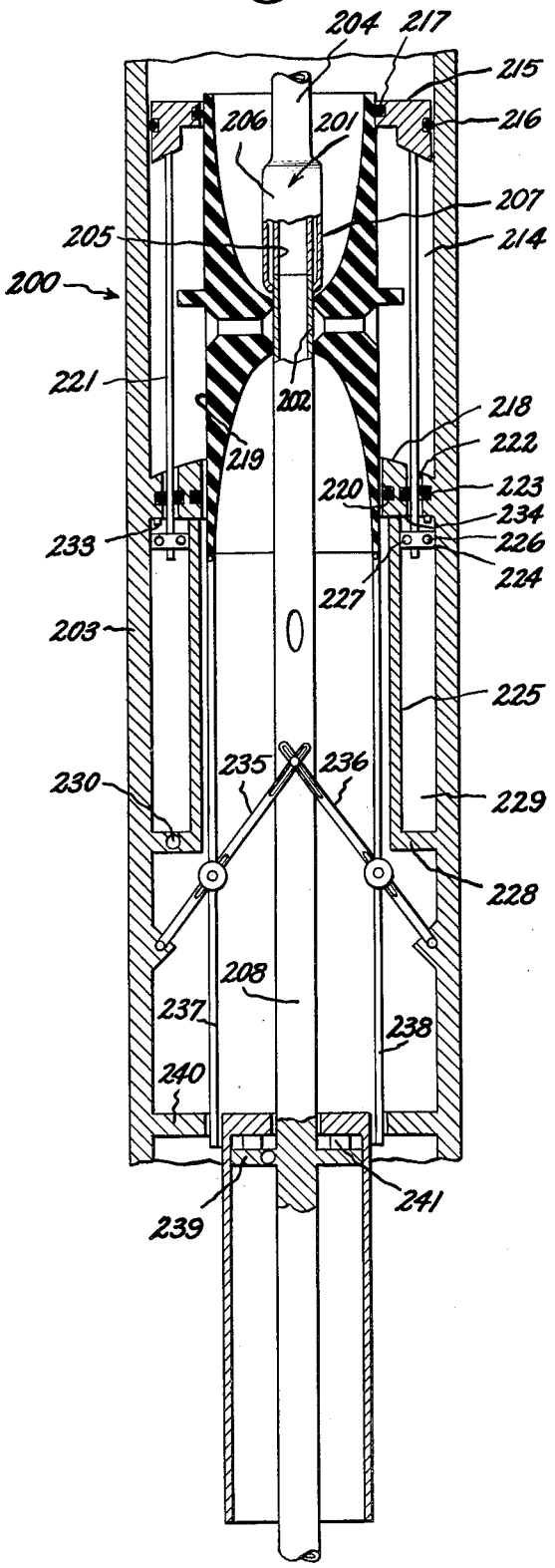
FIG. 5 is a schematic partial cross-sectional view illustrating another preferred embodiment of the instant invention.
Figure 6:
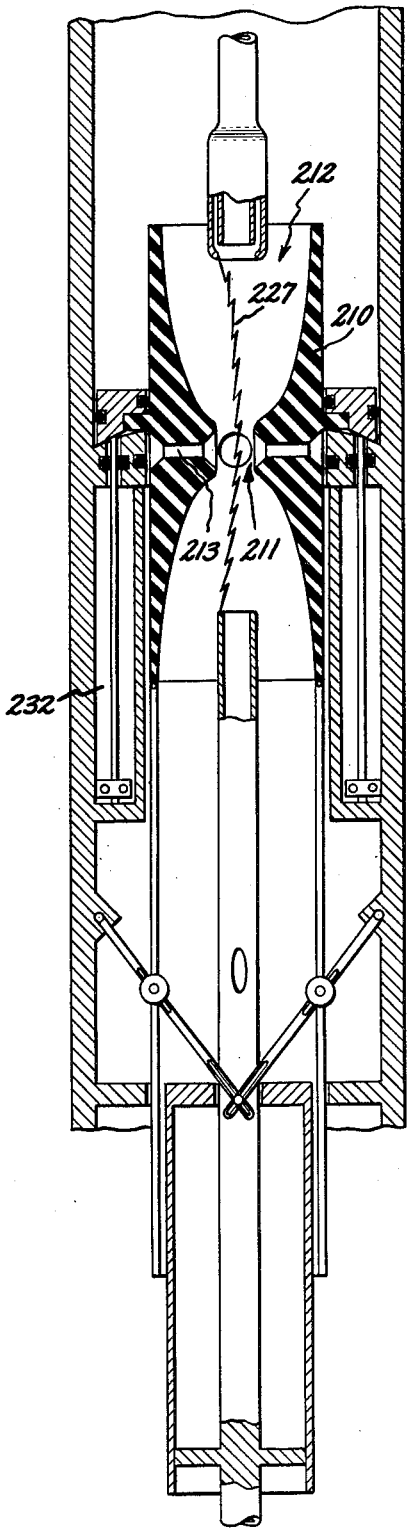
FIG. 6 is a partial schematic cross-sectional view showing the embodiment illustrated in FIG. 5 with the contacts in the open position.

A further embodiment of my invention is illustrated in FIGS. 5 and 6. The circuit breaker 200 comprises a pair of separable contacts 201 and 202 disposed within interrupter housing 203 filled with a suitable arc extinguishing gas at a moderate pressure, e.g., sulfur hexafluoride, $SF_6$, at a pressure of about 50 psi gauge. Upper electrode 201 comprises a conductive contact rod 204 suitably mounted to an end wall of the housing (not shown) and a tubular contact member 205 disposed within conductive tube 206 which terminates in a plurality of flexible contact fingers 207. Tube 205 abuts contact tube 202, and contact fingers 207 contact the outer surface of movable contact tube 202, thereby making electrical contact with contact 202 which is carried by movable conductive contact rod 208.

Surrounding contacts 201 and 202 is a nozzle 210 of electrically insulating material. As shown in FIG. 6, nozzle 210 includes a narrow region, referred to herein as the nozzle throat 211, where the flow passage 212 through nozzle 210 is of its smallest cross-sectional area. Extending radially through the walls of nozzle 210 and intersecting throat 211 at their inner ends are a plurality of injection passages 213 circumferentially spaced around nozzle throat 211, through which arc extinguishing gas can be injected into the throat 211 of the nozzle 210, as will be described below. At the radially-outer ends of passages 213 is an annular chamber 214, within which arc extinguishing gas is stored during normal closed, current carrying operation of breaker 200. Chamber 214 has one end defined by movable annular ring 215 which sealingly engages housing 203 and nozzle 210 by O-rings 216, 217, respectively. The opposite end of chamber 214 is defined by annular wall 218 which is rigidly affixed to housing 203 and which closely approaches the radially-outer surface 219 of nozzle 210 and is sealed by O-ring 220. Attached to annular ring 215 is a plurality of actuating rods 221 which pass through a plurality of openings 222, respectively, in wall 218, each of which openings 222 has an O-ring seal 223 disposed therein. Rods 221 are connected to annular ring 224 disposed between housing 203 and annular wall 225 with O-ring 226 disposed between ring 224 and housing 203 and O-ring 227 disposed between ring 224 and wall 225. Annular end wall 228 is fixed to housing 203 and wall 225 and forms an enclosed volume 229 between housing 203 and wall 225. Wall 225 includes a check valve 230 for allowing gas to escape from space 229 when ring 224 is driven downward. A check valve (not shown) would be provided in ring 224 to allow escape of gas from chamber 232, FIG. 6, when the contacts reclose. A plurality of pyrolytic cartridges 233 is disposed on the lower surface 234 of wall 218 adjacent annular ring 224. Levers 235, 236 are secured at one end to housing 203 and at the other end to rod 208 and are operated by drive rods 237, 238, respectively, which are also connected to nozzle 210. The length of levers 235, 236 may be adjusted to provide for adjustment of length of travel of contact 202 relative to the degree of travel of rods 237, 238 and consequently nozzle 210. An annular shoulder 239 is fixed to rod 208 so that when the contacts are closed shoulder 239 is axially adjacent fixed annular wall 240 attached to housing 203. A plurality of pyrolytic cartridges 241 is disposed between shoulder 239 and wall 240 to provide a rapid opening means for rapid separation of the contacts under fault conditions.

In operation, pyrolytic cartridges 233 are detonated by a detonator (not shown) similar to those described above, whenever the current flowing through the circuit including breaker 200 exceeds a predetermined level as determined by a detector (not shown) as described above. This causes annular wall 215 to be rapidly driven downward toward wall 218 simultaneously with the opening of contacts 201, 202, thereby compressing the insulating gas disposed within the chamber 214. On or more of cartridges 241 may be detonated simultaneously with one or more of cartridges 233 to rapidly separate contacts 201, 202 and to move nozzle 210 to force a blast of the compressed gas through passages 213 into the throat 211 of the nozzle 210 to cool and extinguish an arc 227 drawn between the opened contacts.

From the above it should be obvious that many constructions may employ my novel combination of pyrolytic cartridge means to open contacts rapidly upon occurrence of a fault condition with conventional opening apparatus for opening a circuit breaker when opening is required at other times.

Best Mode

I contemplate as the best mode of practicing my invention the embodiment illustrated in FIGS. 5 and 6, using sulfur hexafluoride, $SF_6$, gas as insulating gas stored at a pressure of about 50 psi gauge.

My invention as described herein provides a mechanism whereby high power for rapid contact separation is provided for fault current or other overload current operation without requiring massive breaker operating means for all normal operating current circuit interruptions.

I claim:

1. A circuit breaker comprising:

a first main contact;

a second main contact affixed to an actuating rod and movable relative to said first main contact between a first position in which said first main contact is in abutment with said second main contact and a second position in which said first main contact and said second main contact are separated;

nozzle means surrounding said contacts;

an enclosed chamber for storing insulating gas, said chamber being in flow communication with said nozzle means;

current detection means connected to said first and second contacts for measuring a parameter of current flow through said contacts;

a first actuating means for moving said second contact relative to said first contact when opening is required during operation while the magnitude of current flow is below a predetermined level; and a second actuating means for moving said second contact relative to said first contact when said parameter of current flow through said contacts detected by said current detection means indicates that rapid contact separation is required.

2. The apparatus of claim 1 wherein said current detection means comprises a current level detection means for detecting magnitude of current flow through said contacts, said second actuating means comprises a plurality of pyrolytic cartridges and detonator means connected to said cartridges for detonating at least one of said cartridges when said magnitude of said current detected by said current level detection means exceeds a predetermined level.

3. The apparatus of claim 2 further comprising piston means for compressing said insulating gas stored in said enclosed chamber.

4. The apparatus of claim 3 wherein said plurality of pyrolytic cartridges is secured to an annular shoulder rigidly affixed to said actuating rod, said actuating rod and said shoulder being surrounded by a generally cylindrical, fixed casing, spaced from and concentric with said rod, and said casing having a ring affixed thereto, such that when said contacts are in said first position, said shoulder is disposed axially closely adjacent said pyrolytic charges; said casing, ring and shoulder forming a chamber for containing said pyrolytic charges.

5. The apparatus of claim 3 wherein said plurality of pyrolytic cartridges comprises a first plurality of pyrolytic cartridges disposed adjacent an annular disk rigidly affixed to said actuating rod, said piston means comprises an annular piston disposed at one end of said enclosed chamber having a plurality of drive rods attached at one end thereof to said annular piston and attached at the opposite end of said rods to an annular ring disposed axially adjacent said first plurality of pyrolytic cartridges further comprises a second plurality of pyrolytic cartridges disposed on an annular fixed wall disposed adjacent said piston means within said chamber when said contacts are in abutment, said second plurality of pyrolytic cartridges being disposed on a surface of said fixed wall adjacent said annular ring, and said detonator means comprises means for detonating one of said first plurality of cartridges when said magnitude of said current detected by said current level detection means exceeds said predetermined level, and means for detonating at least one of said second plurality of cartridges after a time lapse following detonation of said at least one of said first plurality of cartridges sufficient to allow said piston means to compress said insulating gas in said chamber.

6. The apparatus of claim 5 wherein said first plurality of pyrolytic cartridges comprises 20 pyrolytic cartridges, said second plurality of pyrolytic cartridges comprises 20 cartridges, and said means for detonating comprises means to detonate simultaneously two of said first plurality of cartridges when said magnitude of said current exceeds said predetermined level and means to detonate simultaneously two of said second plurality of cartridges after a time lapse following detonation of said two of said first plurality of cartridges sufficient to allow said piston means to compress said insulating gas in said chamber.

7. The apparatus of claim 1 wherein said current detection means comprises means for detecting rate of change of current flow through said contacts, and said second actuating means comprises a plurality of pyrolytic cartridges and detonator means connected to said plurality of cartridges for detonating at least one of said cartridges, when said rate of change of current detected by said detection means exceeds a predetermined level.

8. The apparatus of claim 7 further comprising piston means for compressing said insulating gas stored in said enclosed chamber, said piston means being affixed to said actuating rod and being movable therewith.

9. The apparatus of claim 1 further comprising nozzle means surrounding said first and second contacts and having a throat which surrounds said contacts when said contacts are in abutment, said nozzle having gas injection passages therein for supplying insulating gas to said throat from said chamber when said second contact is moved relative to said first contact, said chamber comprising an annular chamber surrounding said nozzle and enclosed within a generally cylindrical casing and having a fixed annular wall at one end thereof rigidly affixed to said casing and said piston means comprises movable annular piston at the opposite end of said chamber from said fixed wall and a plurality of drive rods attached to said annular piston and passing through a plurality of openings, respectively, in said fixed wall and attached to a drive ring, and said second actuating means includes a plurality of pyrolytic cartridges disposed about the periphery of said fixed wall in juxtaposition to said drive ring.

10. The apparatus of claim 9 wherein said current detection means comprises a current level detection means for detecting magnitude of current flow through said contacts, and said second actuating means comprises a detonator means connected to said plurality of cartridges for detonating at least one of said cartridges when said magnitude of said current detected by said current level detection means exceeds a predetermined level.

11. The apparatus of claim 9 wherein said current detection means comprises means for detecting rate of change of current flow through said contacts, and said second actuating means comprises detonator means connected to said plurality of cartridges for detonating at least one of said cartridges when said rate of change of current detected by said detection means exceeds a predetermined level.

* * * * *